US007357253B2

(12) United States Patent
Scott et al.

(10) Patent No.: US 7,357,253 B2
(45) Date of Patent: Apr. 15, 2008

(54) PACKAGE FOR LIGHTBULBS AND METHOD OF MAKING SAME

(75) Inventors: Thomas Scott, Lynchburg, VA (US); Randall L. La Veau, Des Plaines, IL (US); Roger Scruggs, Lynchburg, VA (US)

(73) Assignee: Bell Incorporated., Sioux Falls, SD (US)

( * ) Notice: Subject to any disclaimer, the term of this patent is extended or adjusted under 35 U.S.C. 154(b) by 478 days.

(21) Appl. No.: 11/103,349

(22) Filed: Apr. 11, 2005

(65) Prior Publication Data

US 2005/0247590 A1 Nov. 10, 2005

Related U.S. Application Data

(63) Continuation-in-part of application No. PCT/US2004/013197, filed on Apr. 29, 2004.

(60) Provisional application No. 60/466,113, filed on Apr. 29, 2003.

(51) Int. Cl.
*B65D 85/42* (2006.01)

(52) U.S. Cl. ..... 206/419; 206/421

(58) Field of Classification Search ..... 206/418–422, 206/525.1, 775, 784; 229/87.01, 87.02
See application file for complete search history.

(56) References Cited

U.S. PATENT DOCUMENTS 2,825,496 A 3/1958 Miessler
2,892,581 A 6/1959 Amatel
2,905,316 A 9/1959 Forrer
3,053,431 A 9/1962 Jacobs
3,138,256 A 6/1964 Miessler
3,255,879 A * 6/1966 Paige ..... 206/422
3,693,866 A 9/1972 Struble
3,822,785 A 7/1974 Getz et al.
3,968,924 A 7/1976 Tyrseck
4,058,211 A * 11/1977 Barbieri et al. ..... 206/422
4,185,766 A 1/1980 Davidson et al.
4,231,510 A 11/1980 Beard
4,773,539 A 9/1988 Nock
4,903,892 A * 2/1990 McNair et al. ..... 206/422
4,997,087 A 3/1991 Lorenz
5,100,052 A 3/1992 Vajtay
5,292,060 A 3/1994 Focke et al.
5,730,289 A * 3/1998 Cappels ..... 206/418
6,273,329 B1 8/2001 Zavatone
6,386,441 B2 5/2002 Philips
6,390,290 B1 5/2002 Focke et al.
6,398,024 B2 6/2002 Koehn
6,431,365 B1 8/2002 Money
6,467,682 B2 10/2002 Toth et al.
6,471,062 B2 10/2002 Usui et al.
6,527,166 B1 3/2003 Focke et al.

* cited by examiner

*Primary Examiner*—Luan K Bui
(74) *Attorney, Agent, or Firm*—Brinks Hofer Gilson & Lione

(57) ABSTRACT

A package includes four outer walls and an internal wall running between two of the outer walls. The four outer walls and the internal wall define first and second cells. First and second pivot members are disposed in the first and second cells. A first pair of hinge members connects the first pivot member to two of the walls defining the first cell and a second pair of hinge members connects the second pivot member to two of the walls defining the second cell.

14 Claims, 11 Drawing Sheets

PACKAGE FOR LIGHTBULBS AND METHOD OF MAKING SAME

RELATED APPLICATIONS

The present patent document is a continuation-in-part application of PCT application Ser. No. PCT/US2004/013197, filed Apr. 29, 2004, designating the United States and published in English, which claims the benefit of the filing date under 35 U.S.C. § 119(e) of Provisional U.S. Patent Application Ser. No. 60/466,113 filed Apr. 29, 2003. All of the foregoing applications are hereby incorporated by reference

BACKGROUND

The present invention relates to a package, and method for making a package, in particular, a glued sleeve with plural inner cells and open-end faces for packaging products, for example, light bulbs.

Currently, multipack packaging for light bulbs (comprising four or more light bulbs) includes several types of packages. However, current designs are relatively expensive to make, do not protect the light bulbs adequately, or are difficult for consumers to use.

SUMMARY

Several aspects of the present invention are directed to a package, and a method of making a package, that includes a combination of offset flaps, glued so that the product being held, such as light bulbs, are guided into separate cells. Pivoting inner partitions allow the bulbs to be loaded without chiming of the bases. The open faced design allows viewing of the product in retail environment, and the cutouts at the ends of the flaps allow locking of the fragile product as it loads.

In one aspect of the present invention, a package includes four interconnected walls defining a cell. A pivot member is disposed within the cell. A pair of hinge members connects the pivot member to two of the walls.

In another aspect of the present invention, a package includes four outer walls and an internal wall running between two of the outer walls. The four outer walls and the internal wall define first and second cells. First and second pivot members are disposed in the first and second cells. A first pair of hinge members connects the first pivot member to two of the walls defining the first cell and a second pair of hinge members connects the second pivot member to two of the walls defining the second cell.

In another aspect of the present invention, a blank for producing a package includes a first glue panel, a first pivot panel joined to the first glue panel, a second glue panel joined to the first pivot panel, a plurality of serially joined wall panels including a first wall panel and a second wall panel, the first wall panel joined to the second glue panel, a third glue panel joined to the second wall panel of the plurality of wall panels, a second pivot panel joined to the third glue panel, and a fourth glue panel joined to the second pivot panel.

In another aspect of the present invention, a method of folding a blank includes providing a blank, folding the first glue panel, the first pivot panel and the second glue panel, as a unit, and attaching the first glue panel to the back wall panel. The method also includes folding the fourth glue panel, the second pivot panel and the third glue panel, as a unit, and attaching the fourth glue panel to the side wall panel. The method also includes folding the first glue panel, the first pivot panel, the second glue panel, the inner wall panel and the back wall panel, as a unit, and attaching the second glue panel to the front wall panel. The method also includes folding the fourth glue panel, the second pivot panel, the third glue panel, second back wall panel and the second side wall panel, as a unit, and attaching the third glue panel to the inner cell wall panel.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
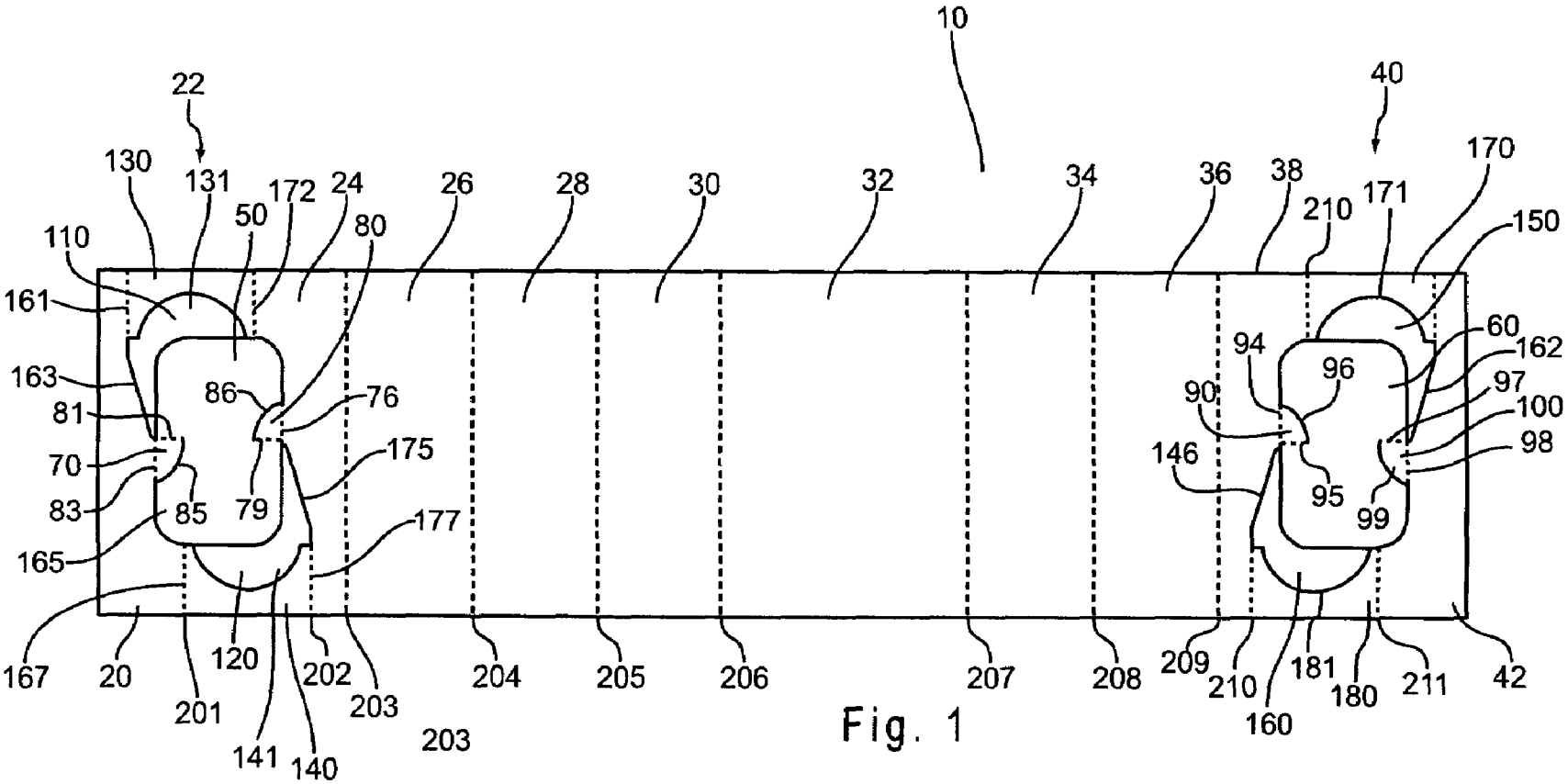
FIG. 1 is first embodiment of a blank used to create a package in accordance with the present invention.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The following description is provided with reference to a package used to hold light bulbs. It is to be understood that the invention should not be so narrowly construed to limit the package for use only with light bulbs. The package may be used to hold other products that are sold in multiple quantities, which products need to be easily machine packaged and easily extracted from the package by the product user. Examples of other products include: ornaments, bottles (including wine, liquor, lotions, shampoos, and the like), food products, glassware, cups, balls (including golf balls, baseballs, etc.), perfume, vitamins/over the counter pharmaceuticals, bowls, etc. Additionally, the term package is meant to be construed broadly and includes any type of container, carton, box, etc.

The package may be made of claycoated newsback (a recycled grade) or other suitable material, depending on the product or products to be held. Other suitable materials include, but are not limited to, solid bleach sulfate, solid unbleached sulfate, single face and traditional corrugated, PVC and liner board. When used to hold light bulbs the package is preferably claycoated newsback, approximately 0.016+0.001/−0.004 inch in thickness. Further, the package can be either unprinted or printed in sheet form with a graphic design using, for example 1) oil based or soy based ink, and 2) varnish or water-based acrylic coating which can be applied by the offset lithographic, flexographic, or gravure printing process.

Figure 2:
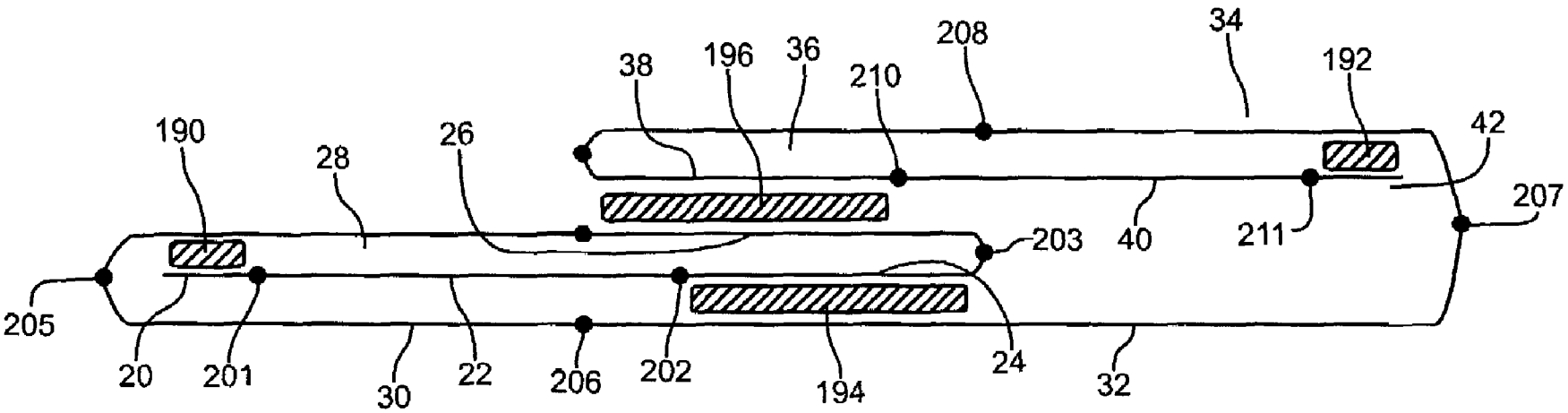
FIG. 2 is a top view of an embodiment of the glued and folded blank of FIG. 1.
Figure 3:
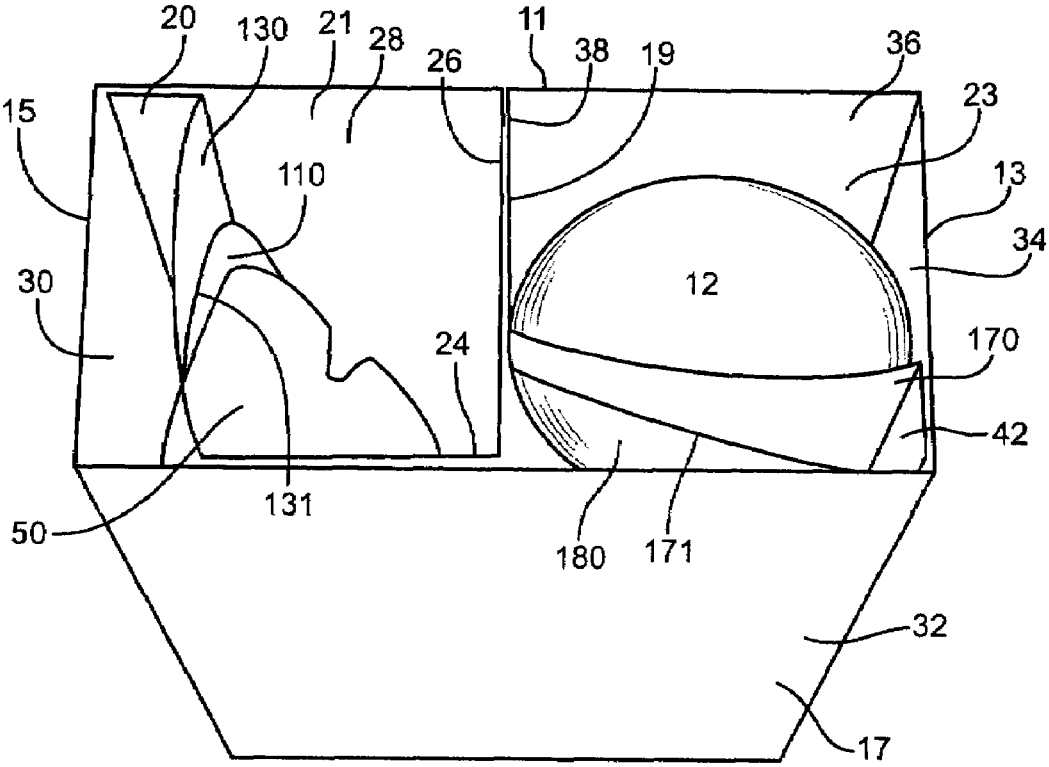
FIG. 3 is a perspective view of an embodiment of the package from the blank of FIG. 1 holding a light bulb.
Figure 4:
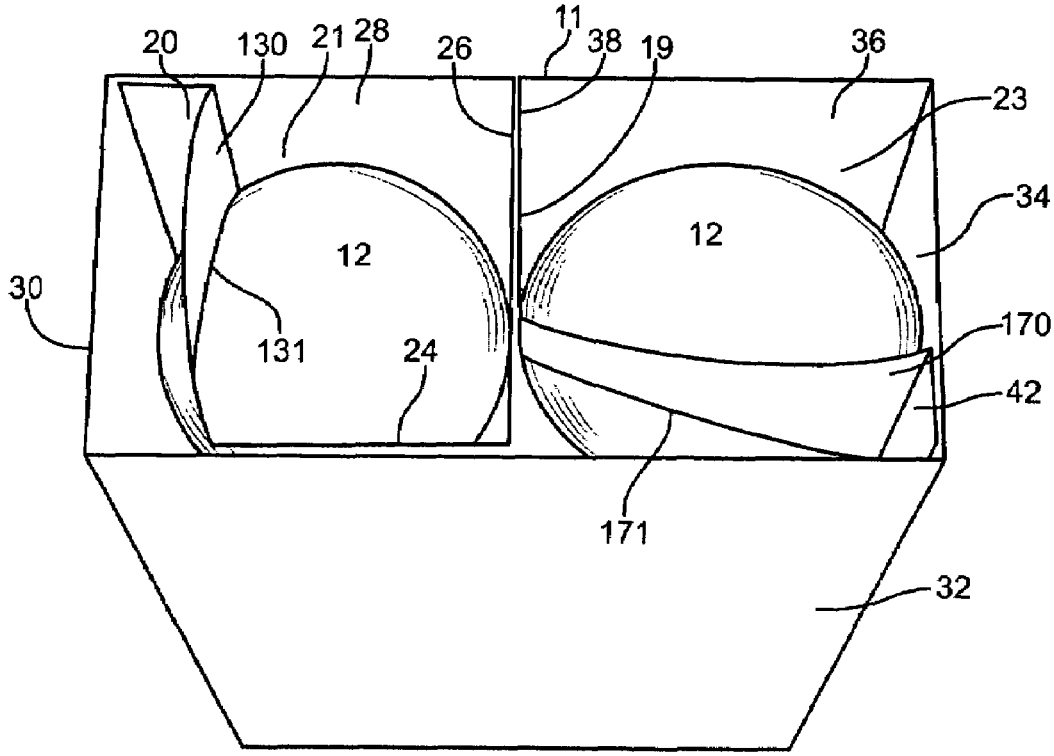
FIG. 4 is another perspective view of an embodiment of a package from the blank of FIG. 1 holding light bulbs.

As on overview, FIG. 1 shows a blank 10 for making a first embodiment of a package. FIG. 2 shows a schematic view of one embodiment of a folded and glued package, corresponding to the top of FIG. 1 after the blank is folded and glued. FIG. 2 is not to scale and the actual package would be almost completely flat in this state. FIGS. 3 and 4 show one open face of the package. It is to be understood that the opposite end of the package has an open face with a similar, but differently oriented, configuration, with the walls 11, 13, 15, 17, and 19 extending the entire length of the package.

The blank 10 may be prepared by die cutting a unprinted or printed sheet in an autoplaten die cutter such as a Bobst die cutter or in a rotary die cutter such as a Zerand 32" rotary die cutting system, which produces blanks 10 that have been cut and creased according to a master CAD drawing, and example of which is shown in FIG. 1. The blank 10 includes twelve panels or sections 20, 22, 24, 26, 28, 30, 32, 34, 36, 38, 40, and 42.

The blank 10 includes first, second, third and fourth glue panels, 20, 24, 38 and 42. By "glue panel" is meant that in a preferred embodiment, glue is applied to the glue panel to attach the glue panel to another panel. Although referred to as "glue" panels, other attachment schemes are possible to attach the panels. For example, other types of adhesives or mechanical fasteners such as staples can be used. In addition, glue may be applied to other panels, instead of the glue panels, such as panels 26, 28, 32, or 34, which are glued to panels 38, 20, 24 and 42, respectively.

The blank 10 includes first and second pivot panels, 22 and 40, respectively. The first pivot panel 22 includes cutout sections 110, 120, locking portions 130, 140, pivot member 50, and hinge members 70, 80. The second pivot panel 40 includes cutout sections 150, 160, locking portions 170, 180, pivot member 60, and hinge members 90, 100.

The blank 10 also includes a plurality of wall panels, which form the walls of the assembled package. The wall panels include inner cell wall panel 26, the first and second back wall panels 28 and 36, first and second side wall panels 30, 34 and front wall panel 32.

In addition, the blank 10 includes fold lines, or scores, as shown in FIGS. 1 and 2 (as solid circles on FIG. 2). In other Figures, dashed lines indicate fold or score lines and solid lines indicate cut lines. In this particular embodiment, score lines 201, 202, 210 and 211 are not straight from top to bottom. For example, score line 201 has a straight portion 161, then angles right along a cut line 163, then goes down to a straight portion 83, then goes down and curves to the right along another cut line 165 and then goes straight down to the bottom 167. Thus, portions 161 and 167 are offset from each other. Similarly, score line 202 has a straight portion 172, then angles right along a cut line 173, curves to the right and down along portion 173, angles to the right along portion 175, then goes straight down to the bottom 177. Thus, portions 172 and 177 are offset from each other. Scores lines 210 and 211 have a corresponding configuration.

The pivot members 50, 60 are shaped generally rectangular. The hinge member 70 includes a curved portion 85, a first hinge portion 83 that lines up with the cut line 165 of the pivot panel, and a second hinge portion 81 generally perpendicular to the first hinge portion 83. Similarly, hinge member 80 includes hinge portions 79, 80 and curved portion 86; hinge member 90 includes hinge portions 94, 95 and curved portion 96; and hinge member 100 includes hinge portions 97, 98 and curved portion 99. The first portion 83 hingedly connects the hinge member 70 to the first glue wall 20, and the second portion 81 hingedly connects the hinge member 70 to the pivot member 50.

The cutout portions 110, 120 are defined in part by the generally curved engaging edges 131, 141 of the locking portions 130, 140 and by two generally straight portions 163, 175, respectively. Similarly, the cutout portions 150, 160 are defined in part by the generally curved engaging edges 171, 181 of the locking portions 170, 180 and by two generally straight portions 162, 164, respectively.

In the embodiment shown in FIG. 1 the approximate dimensions of the panels are as follows: panels 20 and 42 are 9/16 inch wide at the top and 1.736 inch wide at the bottom; panel 22 is 2 13/32 inch wide; panels 24 and 38 are 1.736 inch wide at the top and 9/16 wide at the bottom; panels 26, 28, 30, 34 and 36 are 2 3/8 inches wide; and panel 32 is 4 3/4 inches wide. In addition, each of the panels is 6 5/8 inches high.

In another embodiment, the approximate dimensions of the panels are as follows: panels 20 and 42 are 5/8 inch wide at the top and 1.664 inches wide at the bottom; panel 22 is 2 5/16 inches wide; panels 24 and 38 are 1.664 inches wide at the top and 5/8 inch wide at the bottom; panels 26, 28, 30, 34, and 36 are 2 3/8 inches wide; and panel 32 is 4 51/64 inches wide.

In another embodiment, the approximate dimensions of the panels are as follows: panels 20 and 42 are 5/8 inch wide at the top and 1 9/16 inches wide at the bottom; panel 22 is 2 15/32 inches wide; panels 24 and 38 are 1 9/16 inches wide at the top and 5/8 inch wide at the bottom; panels 26, 28, 30, 34 and 36 are 2 7/16 inches wide; and panel 32 is 4 7/8 inches wide.

In another embodiment, the approximate dimensions of the panels are as follows: panels 20 and 42 are 9/16 inch wide at the top and 1 25/32 inches wide at the bottom; panel 22 is 2 15/32 inches wide; panels 24 and 38 are 1 25/32 inches wide at the top and 9/16 inches wide at the bottom; panels 26, 28, 30, 34 and 36 are 2 7/16 inches wide; and panel 32 is 4 7/8 inches wide.

A package may be formed from a blank 10 using any suitable method. In one embodiment, to form the package, the die cut blanks are fed into a folder gluer, such as a Roberts (model 1204 Modular Super Gluer), that pre-folds, glues and folds them into finished packages that are later erected and filled on an automatic packaging machine, such as a Jones or Thiele.

One method for folding and gluing the embodiments disclosed herein is as follows. The method includes several gluing steps and several folding steps. Blank 10 as shown in FIG. 1 is provided. FIG. 2 is a top view of an embodiment of the glued and folded blank of FIG. 1. Referring to FIGS. 1 and 2, the blank 10 is placed printed or clay coated side down in the feeder of the folder Bluer so that first glue panel 20 is on the left. The blank generally includes a coated side which includes graphics and partially forms the outside surface of the package, and an uncoated side which partially forms the inside surface of the package. Each die cut blank 10 may be pre-folded at scores 204 and 208 and returned to a flat state to provide a hinge for later assembly of the package.

Examples of areas where glue is preferably applied are shown as cross hatched rectangles on FIG. 2. In the first gluing step, glue 190 is applied in a straight line approximately ¼ inch from the left edge of the blank 10 on the uncoated side of first glue panel 20. Glue 190 is also applied to the lower right portion of first glue panel 20. Glue 192 is also applied in a straight line approximately ¼ inch from the right edge of the blank 10 to the uncoated side of fourth glue panel 42. Glue 192 is also applied to the lower left portion of fourth glue panel 42. It also possible for glue to be applied to different portions of glue panels 20 and 42. The glue does not have to be applied over the entire cross hatched rectangles shown in FIG. 2. The cross hatched rectangles represent general areas where glue may be applied.

In the first folding step, the first glue panel 20, the first pivot panel 22 and the second glue panel 24 are folded as a unit along score line 203, with the uncoated sides of the blank being folded towards one another, and the first glue panel 20 is attached to the back wall panel 28. Then, the fourth glue panel 42, the second pivot panel 40 and the third glue panel 38 are folded as a unit along score line 209, with the uncoated sides of the blank being folded towards one another, and the fourth glue panel 42 is attached to the side wall panel 34.

Then, in the second gluing step, glue 194 is applied in a straight line approximately ¼ inch from score line 203 on the coated side of second glue panel 24. Glue 194 is also applied to the upper left portion of second glue panel 24. Glue 196 is also applied in a straight line approximately ¼ inch from score 209 on the coated side of third glue panel 38. Glue 196 is also applied to the upper right portion of third glue panel 38.

In the second folding step, the first glue panel 20, the first pivot panel 22, the second glue panel 24, the inner wall panel 26 and the back wall panel 28 are folded as a unit along score line 205, and the coated side of second glue panel 24 is attached to the uncoated side of front wall panel 32 with glue 194. The fourth glue panel 42, the second pivot panel 40, the third glue panel 38, second back wall panel 36 and the second side wall panel 34 are folded as a unit along score line 207, and the coated side of third glue panel 38 is attached to the coated side of the inner cell wall panel 26 with glue 196.

The folded, glued blank 10 then proceeds through a compression section to the gluer delivery where it is retrieved and packed in a corrugated case. The cases of folded blanks are then provided to end users who expand the glued blank 10 to form a package as shown in FIGS. 3 and 4 and insert products into the package.

A package formed from blank 10 and assembled by the process described above is shown in FIGS. 3 and 4. FIG. 4 is a top view of the package containing the two top light bulbs 12. The package includes four outer walls 11, 13, 15, and 17 and an internal wall 19 running between two of the outer walls. Outer wall 11 includes back wall panels 28 and 36 from blank 10. Outer wall 13 is side wall panel 34. Outer wall 15 is side wall panel 30. Outer wall 17 is front wall panel 32. Internal wall 19 includes inner wall panel 26 and glue panel 38. The four outer walls 11, 13, 15, and 17 and the internal wall 19 define first and second cells 21, 23. Preferably, the internal wall 19 does not include any openings between the first and second cells 21, 23. The package is adapted to hold four light bulbs 12, with two light bulbs 12 placed in each cell 21, 23. The bottom two light bulbs (not shown) would look similar but not identical when the package is viewed from the bottom.

FIG. 3 is a top view of the package containing only one of the two top light bulbs 12. In the empty cell 21, the pivot member 50, cutout section 110 and locking portion 130 can be seen.

The cells 21, 23 of the package contain pivot members 50, 60 that pivot at the center with respect to the cell walls, thereby allowing light bulbs from opposite ends to load into the package without interference from each other. The pivot member 50 is hingedly attached to the side walls 11, 17 by the previously described hinge members 70, 80 (not shown in FIG. 3). The hinge members 70, 80 extend outward from the adjacent wall at an acute angle, with hinge portions 83, 76 hingedly attaching the respective hinge members 70, 80 to the adjacent wall and hinge portions 81, 79 hingedly attaching the respective hinge members 70, 80 to the pivot member 50. Pivot member 60 and hinge members 90, 100 have a similar configuration.

In addition, the score lines (for example, lines 161 and 167) of the cell partitions at the top and bottom of the package are preferably offset in the vertical direction to position the pivot members 50, 60 across the cells 21, 23. The pivot members 50, 60 guide the bulbs into the appropriate part of the cells 21, 23 from opposite ends. The pivot members of panels 22, 40 may be used to prevent chiming, or bumping together, of the bases as the bulbs are loaded.

More specifically, as best seen in FIGS. 1 and 3, located at the ends of the two pivot panels 22, 40 are partially semicircular cutout sections 110, 120 and locking portions 130, 170, that lock each of the four light bulbs 12 securely in place. Preferably, the locking portions 130, 170 are parallel to, and offset from, the adjacent walls (e.g., walls 30, 32 respectively). Products (light bulbs in the preferred embodiment) are placed in the package. Four light bulbs are inserted into the open ends, stem side first. When the light bulbs are inserted, the pivot members 50, 60 act as barriers between the two bulbs in a cell and material above and below the cutout sections 110, 120, 150, and 160. The engaging edges 131, 141, 171, and 181 of locking portions 130, 140, 170, and 180 lock or hold the light bulbs in place so they stay in the package.

The design of the cells 21, 23, when combined with proper orientation of the filled packages in a corrugated shipping container, allows for cushioning of the light bulbs 12 and thus serves to minimize the likelihood of breakage in shipping and handling.

Figure 5:
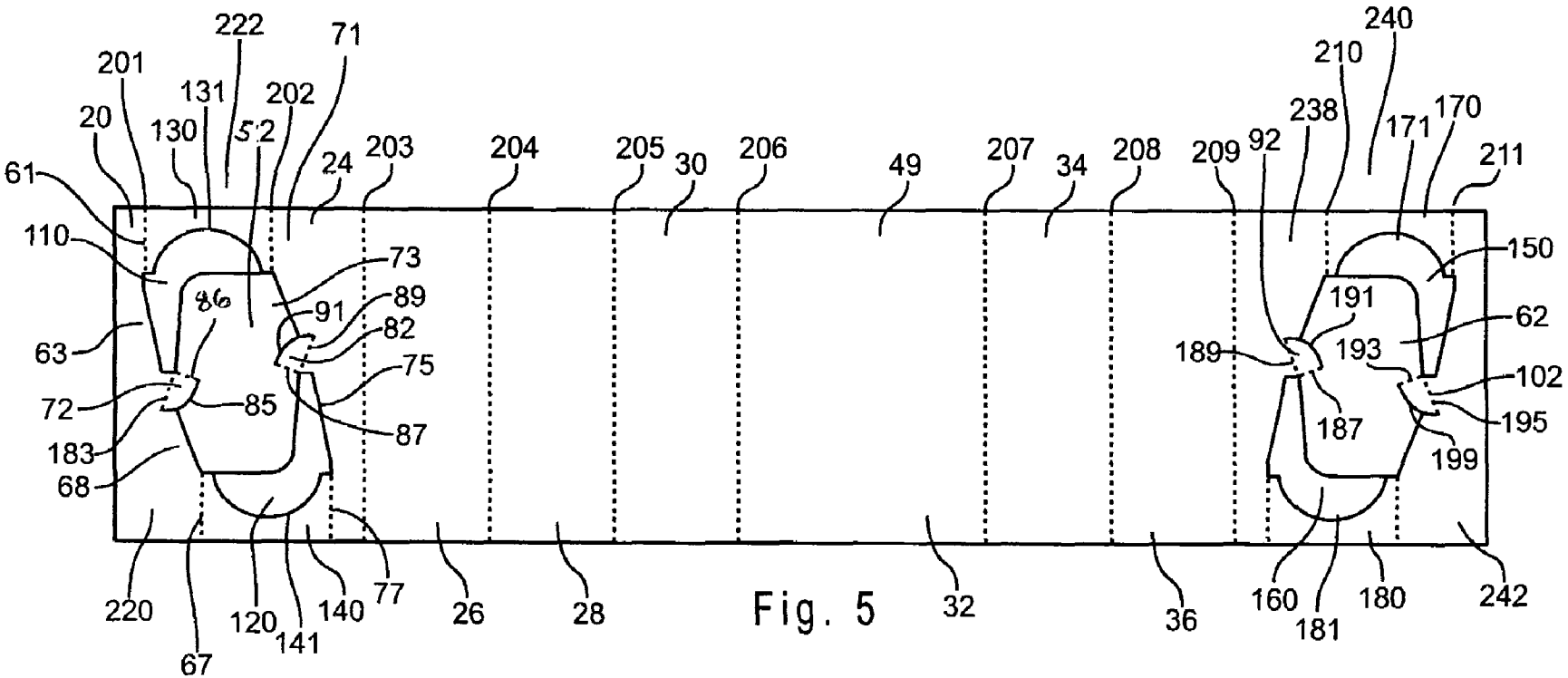
FIG. 5 shows a second embodiment of a blank used to create a package.
Figure 6:
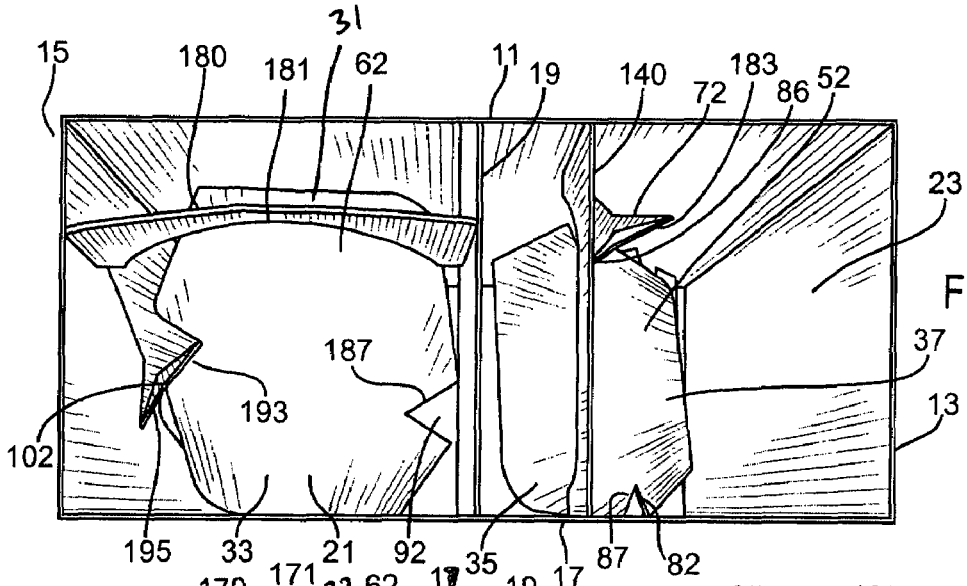
FIG. 6 is a top perspective view of an embodiment of a package from the blank of FIG. 5.
Figure 7:
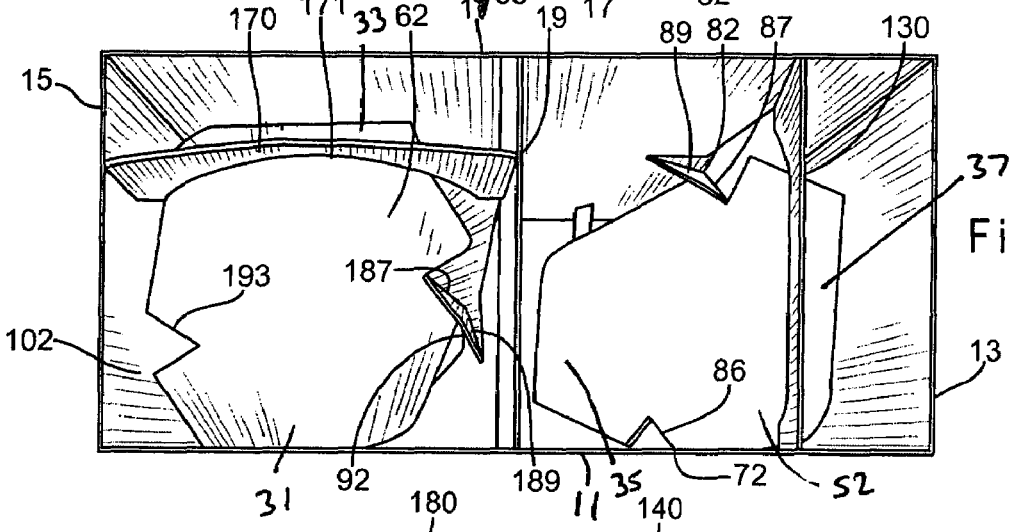
FIG. 7 is a bottom perspective view of an embodiment of a package from the blank of FIG. 5.
Figure 8:
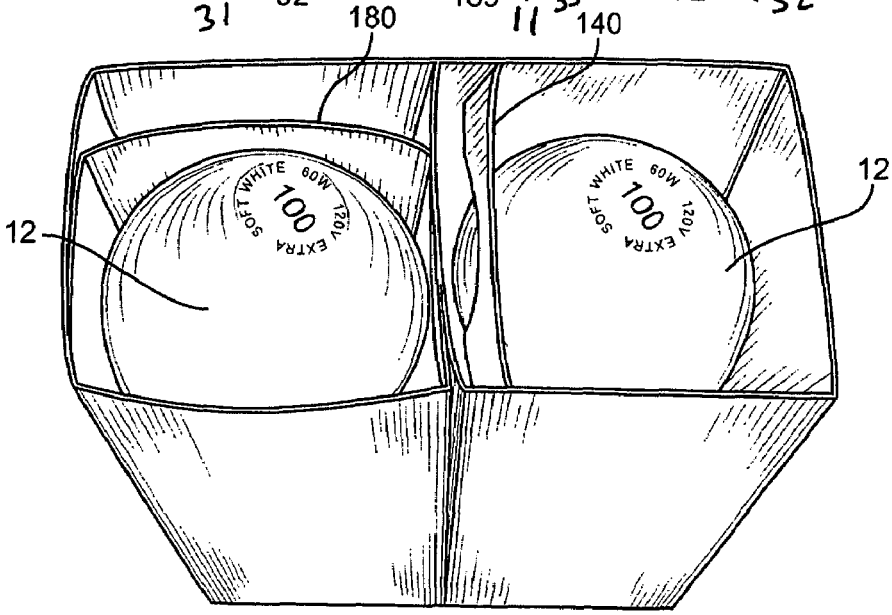
FIG. 8 is a perspective view of the package of FIG. 6 holding light bulbs.

FIG. 5 shows a second embodiment 49 of a blank for producing the package shown in FIGS. 6-8. The blank 49 is similar in many respects to blank 10 in FIG. 1, with the primary difference being in the shape of the pivot panels 222, 240. The blank 49 includes a first glue panel 220. The first pivot panel 222 is joined to the first glue panel 220. The second glue panel 224 is joined to the first pivot panel 222. A plurality of serially joined wall panels 26, 28, 30, 32, 34, 36 is joined to the second glue panel 224. The first of the wall panels 26 is joined to the second glue panel 224. In one embodiment, the plurality of wall panels includes an inner cell wall panel 26, a first back wall panel 28, a first side wall panel 30, a front wall panel 32, a second side wall panel 34, and a second back wall panel 36. A third glue panel 238 is joined to the last wall panel 36 of the plurality of wall panels.

In one embodiment, the last wall panel of the plurality of wall panels is the second back wall panel 36. A second pivot panel 240 is joined to the third glue panel 38. A fourth glue panel 242 is joined to the second pivot panel 240.

The pivot member 52 is connected to the first glue panel 220 and the second glue 224 panel by a pair of hinge members 72, 82. The hinge members 72, 82 are angled towards the respective glue panels 220, 224, in contrast to the previously described hinge members 70, 80 in FIG. 1. The shape of the hinge members 72, 82 and pivot panels 52, 62 in FIG. 5 forces the pivot members to swivel as the package is opened prior to insertion of the products. Thus, the package is moveable from a flat position to an expanded position, with the pivot panel slanting with respect to the cell when the package is moved from the flat position to the expanded position.

Locking portions 130, 140 are disposed adjacent each end of the pivot member 52. Similarly, locking portions 170, 180 are disposed adjacent each end of the pivot member 62. The hinge members 72, 82 include curved portions 185, 91, first hinge portions 183, 86 that angle slightly relative to the first edge of the first glue panel, and second hinge portions 86, 87 generally perpendicular to the first hinge portions 183, 89. The locking portion 130 includes a semicircular engagement portion 131 and an angled portion 63. Thus, the first hinge portions 183, 89 of hinge members 72, 82 are angled towards the respective glue panels 220, 224, in contrast to the first hinge portions 83, 76 of the previously described hinge members 70, 80 in FIG. 1

The blank 49 includes score lines 201, 202, 203, 204, 205, 206, 207, 208, 209, 210, and 211 between adjacent panels which allow the blank to be folded. In the embodiment shown in FIG. 5, the fold line 201 between the first pivot panel 222 and the first glue panel 20 has a straight portion 61, a diagonal portion 63, an angled portion 65, and a straight portion 67. Likewise, the fold line 202 between the pivot panel 222 and the second glue panel 24 includes a straight portion 71, a diagonal portion 73, an angled portion 75, and a straight portion 77. A similar arrangement surrounds the second pivot panel 62.

The blank 49 may be assembled into a package by any of the methods previously described above for blank 10. For example, in one method, the first glue panel 220 is attached to the back wall panel 28, the fourth glue panel 242 is attached to the side wall panel 34, the second glue panel 224 is attached to the front wall panel 32, and the third glue panel 238 is attached to the inner cell wall panel 26.

An embodiment of a package assembled from blank 49 is shown in FIG. 6. The package includes four outer walls 11, 13, 15, 17 and an internal wall 19 running between two of the outer walls. The four outer walls 11, 13, 15, 17 and the internal wall 19 define first and second cells 21, 23. First and second pivot members 62, 52 are disposed in the first and second cells 21, 23. A first pair of hinge members 102, 92 connects the first pivot member 62 to two of the walls 15, 19 defining the first cell 21, and a second pair of hinge members 72, 82 connects the second pivot member 52 to two of the walls 11, 17 defining the second cell 23. The pivot members have free ends 31, 33 and 35, 37 which extend toward, but are preferably not connected to, the adjacent walls 11, 17, 19, and 13. The package is adapted to hold four light bulbs 12, with two light bulbs 12 placed in each cell 21, 23, as shown in FIG. 8.

The hinge members 72, 82 are angled towards the respective glue panels 220, 224, in contrast to the previously described hinge members 70, 80 in FIG. 1. The shape of the hinge members 72, 82, 92, and 102 and pivot panels 52, 62 in FIG. 6 forces the pivot members to swivel as the package is opened prior to insertion of the products. The pivot member 62 is hingedly attached to the side walls 15, 19 by the previously described hinge members 102, 92. The hinge members 102, 92 extend outward from the adjacent walls 15, 19 at an acute angle with respect to the adjacent walls, with hinge portions 195, 189 (189 not visible) hingedly attaching the respective hinge members 102, 92 to the adjacent wall, and hinge portions 193, 187 hingedly attaching the respective hinge members 102, 92 to the pivot member 62. Pivot member 52 has a similar configuration. Thus, the sides of pivot members 52, 62 are pivotally connected to the walls within their respective cells 23, 21.

The present invention also contemplates a two light bulb package (not shown) which would essentially be half of the package shown in FIG. 6. The two light bulb package includes four interconnected walls defining a cell, a pivot member and a pair of hinge members. The hinge members connect the pivot member to two of the walls. Preferably, the pivot member has a solid surface.

The hinge members 72, 82, 92, 102 may include a variety of shapes and orientations. The hinge members in each cell may be connected to either two outer walls (see hinge members 72, 82) or to one of the outer walls and the internal wall (see hinge members 102, 92). Thus, in one embodiment, as shown in cell 21 of FIG. 6, one hinge member 92 of the pair of hinge members is connected to the internal wall 19, and the other hinge member 102 of the first pair of hinge members is connected to one of the outer walls 15. In another embodiment, as shown in cell 23, both hinge members 72, 82 of the pair of hinge members are connected to the outer walls 11, 17.

In one embodiment, each pivot member 52, 62 slants across the respective cell. As shown in FIG. 6, in one embodiment, the first end 31 of the first pivot member 62 is adjacent one of the outer walls 11, the second end 33 of the first pivot member 62 is adjacent another of the outer walls 17, the first end 37 of the second pivot member 52 is adjacent one of the outer walls 13, and the second end 35 of the second pivot member 52 is adjacent the internal wall 19, such that each pivot member slants across the respective cell 21, 23. Thus, in one embodiment, one pivot member slants a first direction and the other pivot member slants in a different direction. Alternatively, both pivot members can slant in the same direction.

FIG. 7 shows a bottom perspective view of an embodiment of a package, which is the opposite end of the top view shown in FIG. 6. The pivot members have free ends 31, 33 and 35, 37 which extend toward, but are preferably not connected to, the adjacent walls 11, 17, 19, and 13. The pivot member 62 is hingedly attached to the side walls 15, 19 by the hinge members 102, 92. Hinge portions 195, 189 (195 not visible) hingedly attach the respective hinge members 102, 92 to the adjacent wall 15, 19, and hinge portions 193, 187 hingedly attaching the respective hinge members 102, 92 to the pivot member 62. The pivot member 52 is hingedly attached to the side walls 11, 17 by the hinge members 72, 82. Hinge portions 183, 89 (183 not visible) hingedly attach the respective hinge members 72, 82 to the adjacent wall, and hinge portions 86, 87 hingedly attaching the respective hinge members 72, 82 to the pivot member 52.

In one embodiment, as best seen in FIGS. 3, 4, 6, and 8, the package includes locking portions 140, 180. The locking portions 140, 180 are preferably disposed at each of the two open ends of each cell 23, 21. In one embodiment, the locking portions 140, 180 have engaging edges 141, 181 with a semicircular shape. The engagement edges 141, 181 of locking portions 140, 180 are adapted to hold a pair of light bulbs 12 within each cell, as shown in FIG. 8. The engagement edges 141, 181 rest against the spherical surface of the light bulb 12 to help hold it within the cell.

Besides the blank shown in FIGS. 1 and 5, various other embodiments of blanks which may be used to create packages similar to those shown in FIGS. 3, 4, and 6-8, are shown in FIGS. 9-13. The primary difference between the embodiments is the shape of the pivot panels.

Figure 9:
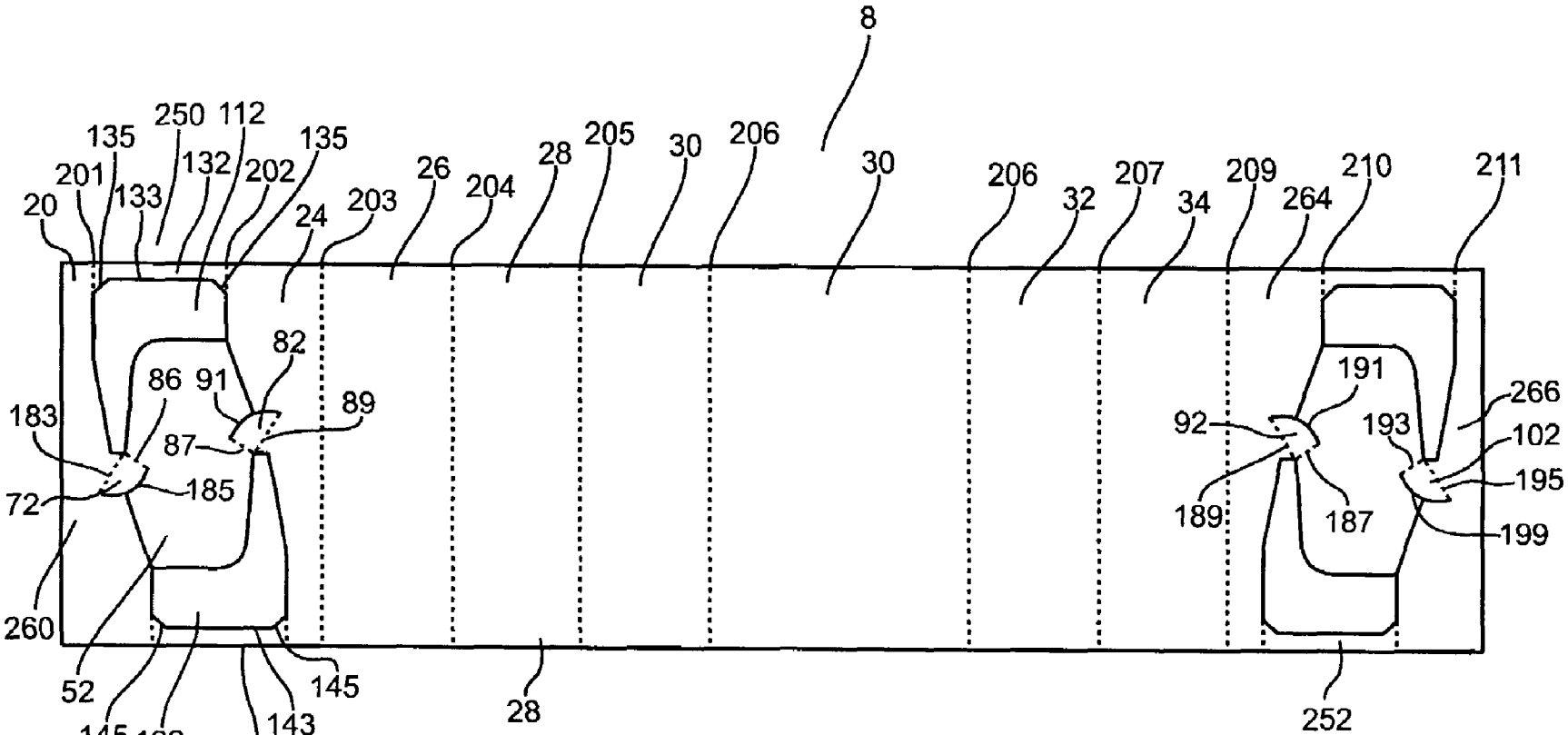
FIG. 9 shows a third embodiment of a blank used to create a package in accordance with the present invention.

A third embodiment of a blank for producing the package is shown in FIG. 9. The blank 8 shown in FIG. 9 is essentially similar to that shown in FIG. 5 except for the shape of the locking portions 132, 142 and the cutout sections 112, 122 in pivot panels 250, 252. The locking portions 132, 142 shown in FIG. 9 include straight portions 133, 143 and angled corners 135, 145. The cutout sections 112, 122 are slightly larger than those of blank 49 in FIG. 5. The glue panels 260, 262, 264, and 266 are also slightly differently shaped. The blank 8 is assembled in a similar fashion as previously described blanks 10 and 49 to form a package which operates in a similar fashion as the packages shown in FIGS. 3, 4, and 6-8.

Figure 10:
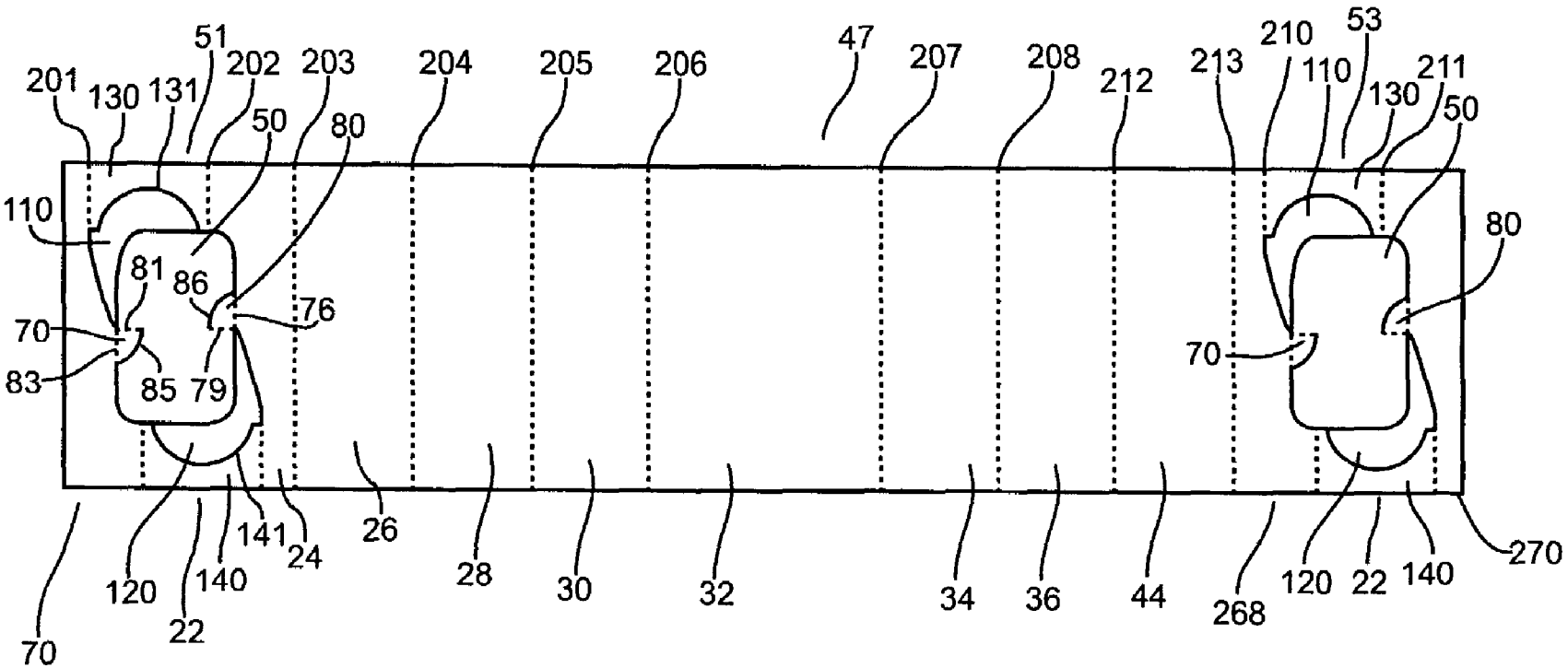
FIG. 10 shows a fourth embodiment of a blank used to create a package in accordance with the present invention.

A fourth embodiment 47 of a blank for producing the package is shown in FIG. 10. Blank 47 is essentially similar to blank 10 of FIG. 1, except that the pivot panels 51, 53 slant in the same direction, as opposed to being mirror images, and the blank 47 contains an additional panel 44 connected to adjacent panels 36, 38 with score lines 212, 213. In a completed package, the additional panel 44 is disposed adjacent panel 26 to form the internal wall of the package, and the pivot members 50, 60 in both cells would be attached to the outer walls, as opposed to having one of the pivot members attached to an inner wall and an outer wall (e.g., as in FIG. 4). Third and fourth glue panels 268, 270 are the same shape as first and second glue panels 20, 24. The blank 47 is assembled in a similar fashion as previously described blanks 10 and 49 to form a package which operates in a similar fashion as the packages shown in FIGS. 3, 4, and 6-8

Figure 11:
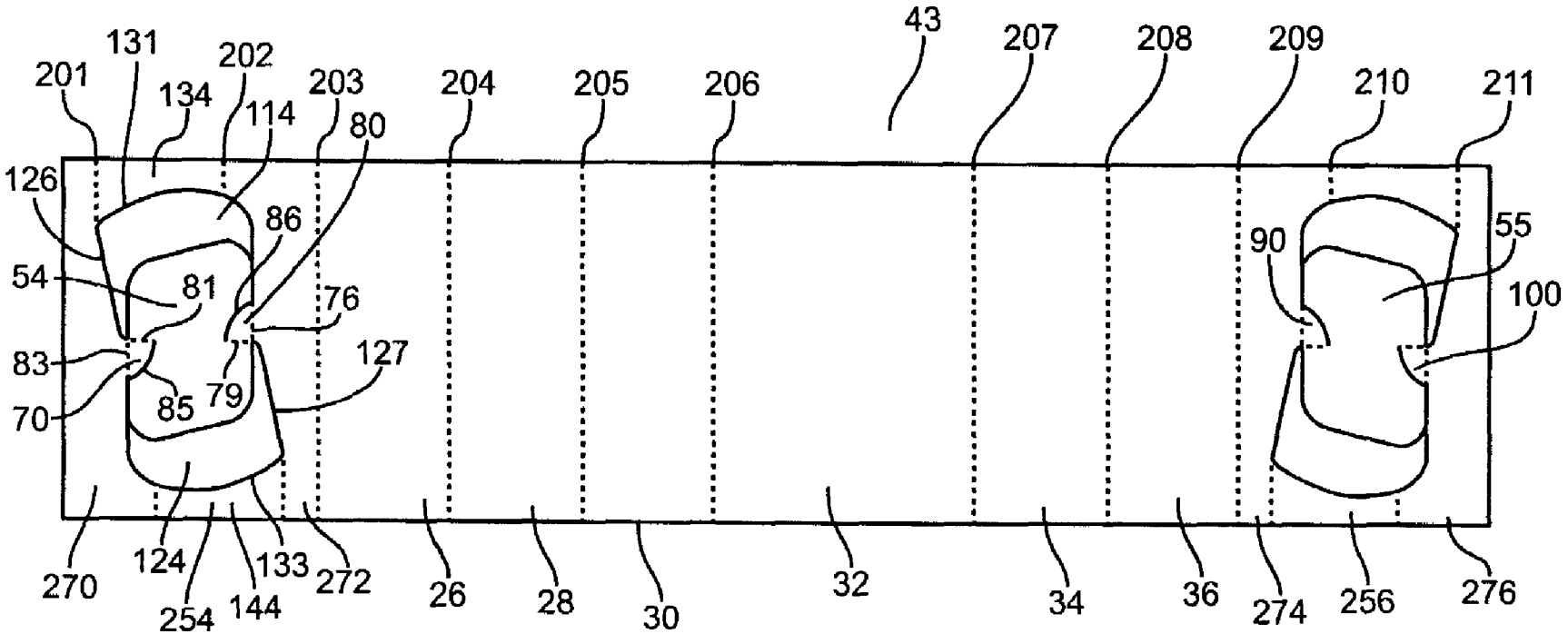
FIG. 11 shows a fifth embodiment of a blank used to create a package in accordance with the present invention.

A fifth embodiment of a blank 43 for producing the package is shown in FIG. 11. The pivot panels 254, 256 include pivot members 54, 55, which are shaped generally like parallelograms. The hinge members 70, 80 include a first hinge portion 83 that lines up with the cut line of the pivot panel, and a second hinge portion 81 generally perpendicular to the first hinge portion 83. The cutout portions 114, 124 are defined in part by the generally curved engagement edges 131, 133 of locking portions 134, 144 and two generally straight portions 126, 127. The glues panels 270, 272, 274, and 276 are also of a slightly different shape than the glue panels of blank 10 in FIG. 1. The blank 43 is assembled in a similar fashion as previously described blanks 10 and 49 to form a package which operates in a similar fashion as the packages shown in FIGS. 3, 4, and 6-8

Figure 12:
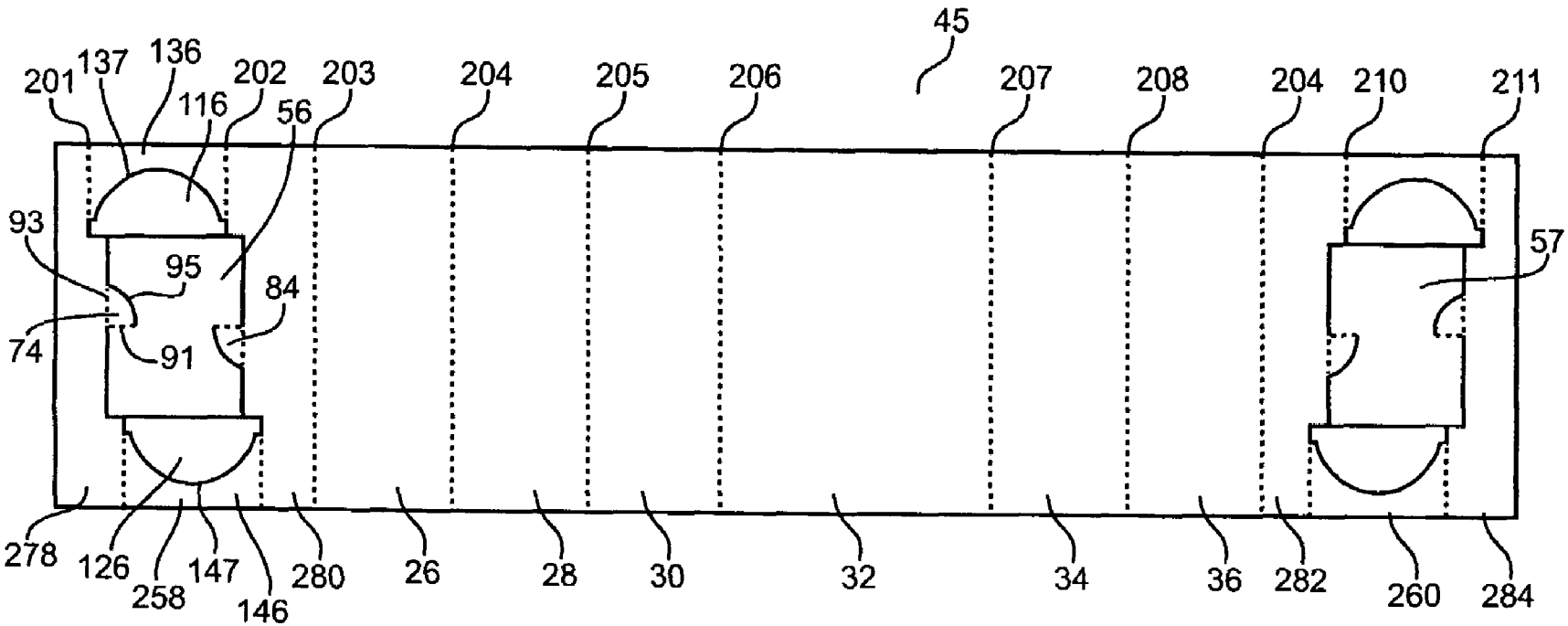
FIG. 12 shows a sixth embodiment of a blank used to create a package in accordance with the present invention.

A sixth embodiment 45 of a blank for producing the package is shown in FIG. 12. The pivot panels 258, 260 include pivot members 56, 57. The pivot members 56, 57 are rectangular in shape. The hinge members 74, 84 include a first hinge portion 93 that lines up with the cut line of the pivot panel, and a second hinge portion 91 generally perpendicular thereto. The locking portions 136, 146 include semicircular engagement edges 137, 147, defining in part semicircular cutouts 116, 126. The glue panels 278, 280, 282, and 284 are also slightly differently shaped. The blank 45 is assembled in a similar fashion as previously described blanks 10 and 49 to form a package which operates in a similar fashion as the packages shown in FIGS. 3, 4, and 6-8

Figure 13:
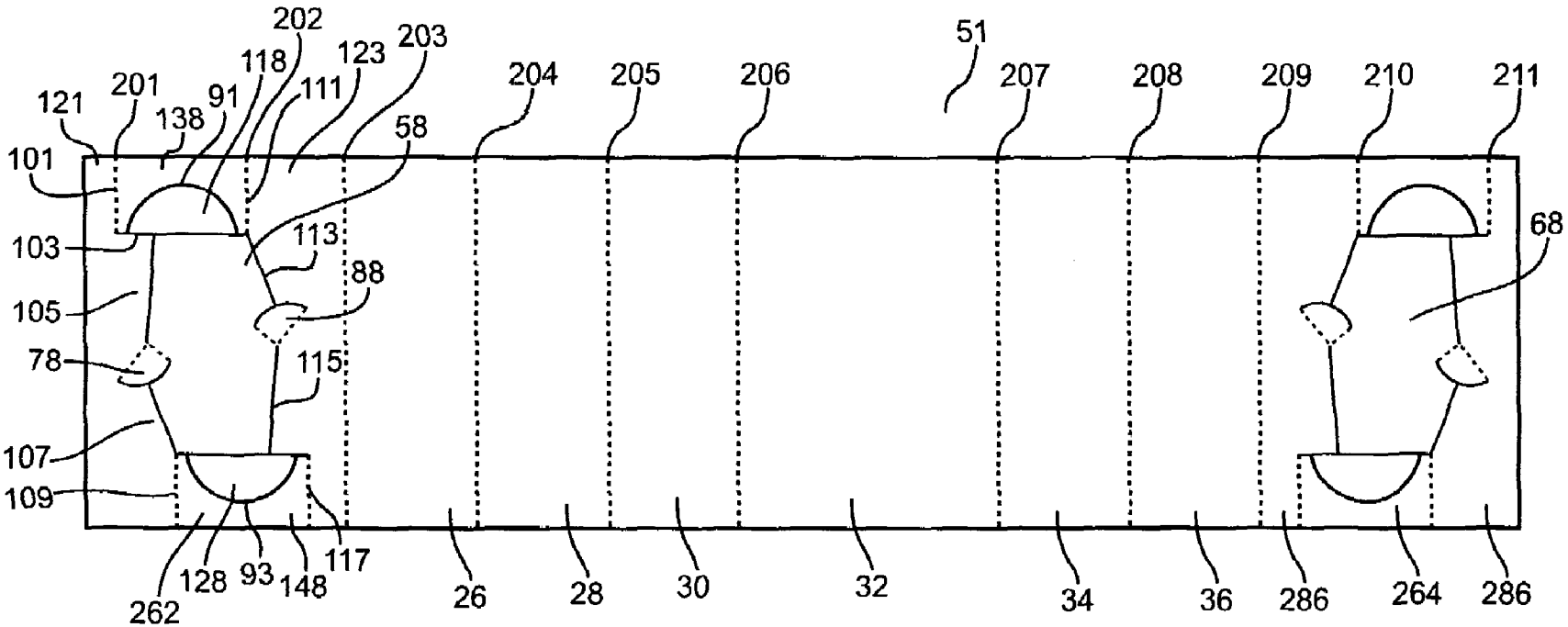
FIG. 13 shows a seventh embodiment of a blank used to create a package in accordance with the present invention.

A seventh embodiment of a blank 51 for producing the package is shown in FIG. 13. The pivot panels 262, 264 include pivot members 58, 68. The pivot member 58 is connected to the first glue panel 121 and the second glue panel 123 by a pair of hinge members 78, 88. Locking portions 138, 148 are disposed adjacent each end of the pivot member 58. The blank 51 does not include cutouts, but rather semicircular portions 118, 128 which are connected by hinges 91, 93 to the locking portions 138, 148. The semicircular portions 118, 128 are adapted to move on the hinges 91, 93 to accommodate a light bulb against the locking portions 138, 148. The fold line 201 at the second edge of the first glue panel 121 has a first straight section 101 adjacent the first pivot panel 262, a perpendicular cut line 103, a slightly angled fold line 105, another angled fold line 107, and a second straight portion 109. Likewise, fold line 202 at the first edge of the second glue panel 123 also includes a first straight section 111, a first angled portion 113, a second angled portion 115, and a second straight portion 117. A similar arrangement surrounds the second pivot panel 264 and glue panels 286, 288.

The shape of the hinge members 78, 88 and pivot members 58, 68 in FIG. 13 forces the pivot members 58, 68 to swivel as the package is opened prior to insertion of the products. This allows for smooth insertion of the products. The package is moveable from a flat position to an expanded position, with the pivot panel slanting with respect to the cell when the package is moved from the flat position to the expanded position. The blank 51 is assembled in a similar fashion as previously described blanks 10 and 49 to form a package which operates in a similar fashion as the packages shown in FIGS. 3, 4, and 6-8

Figure 14:
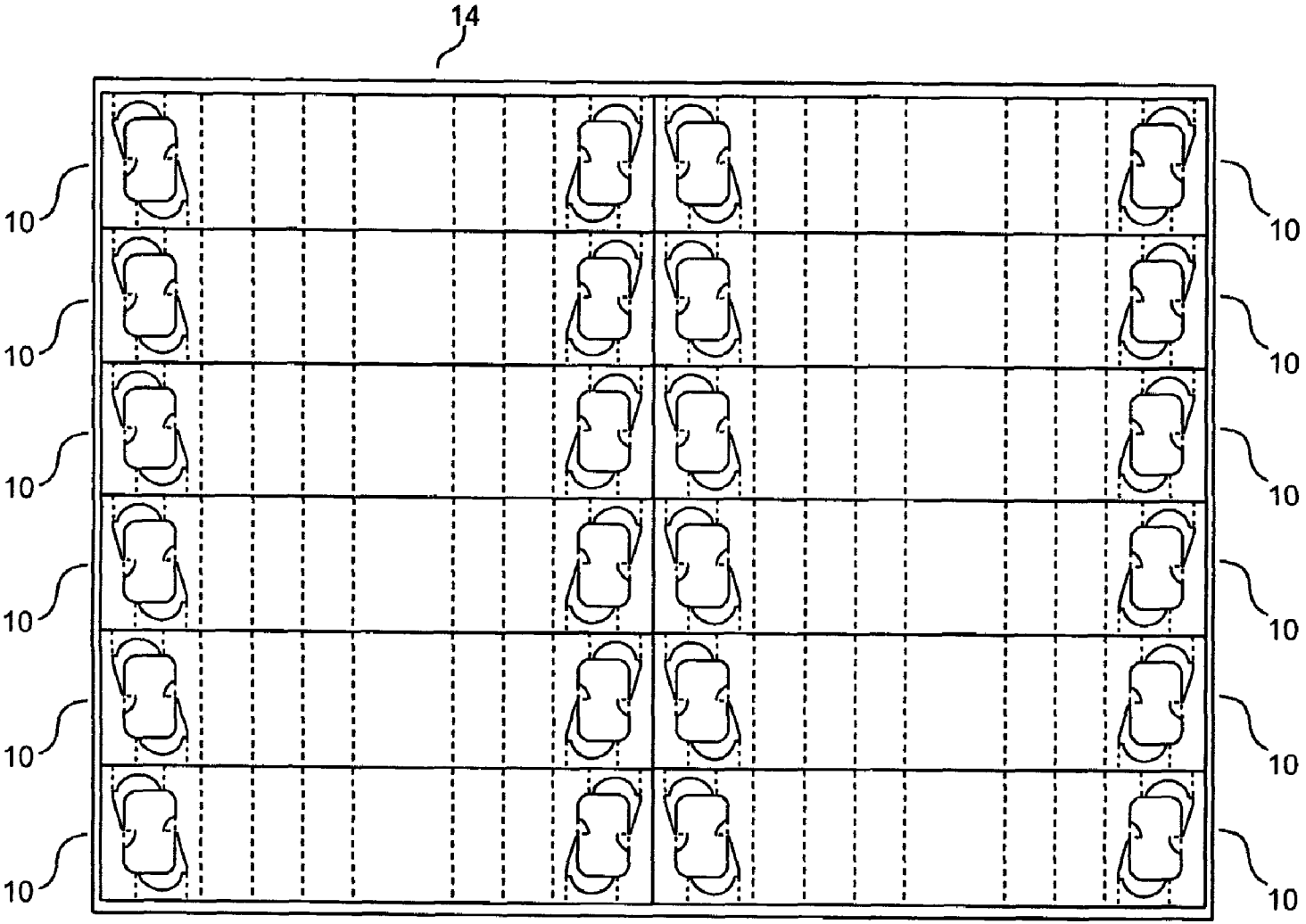
FIG. 14 shows a sheet containing a plurality of blanks used to create a package in accordance with the present invention.

Note that the invention is not limited to blanks having the dimensions described above. In addition, a plurality of blanks can be formed on a large sheet 14 as shown in FIG. 14 for blank 10. Similarly, a plurality of blanks can be formed on a large sheet for any of the blanks 8, 10, 43, 45, 47, 49, and 51.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

What is claimed is:

1. A package comprising:

four outer walls defining a front wall, a rear wall, and first and second side walls;

an internal wall running between the front and rear walls, wherein the four outer walls and the internal wall define first and second cells;

a first pivot member disposed in the first cell;

a second pivot member disposed in the second cell; and a first pair of hinge members connecting the first pivot member to two of the front, rear, first side, and internal walls defining the first cell and a second pair of hinge members connecting the second pivot member to two of the front rear second side, and internal walls defining the second cell;

wherein each pivot member comprises a first end and a second end, the first end of the first pivot member adjacent a first one of the outer or internal walls and the second end of the first pivot member adjacent a second one of the outer or internal walls opposite the first one of the outer or internal walls, the first end of the second pivot member adjacent a third one of the outer or internal walls and the second end of the second pivot member adjacent a fourth one of the outer or internal walls opposite the third one of the outer or internal walls, such that the first pivot member slants across the first cell and the second pivot member slants across the second cell.

2. The package of claim 1 wherein one hinge member of the first pair of hinge members is connected to the internal wall, and the other hinge member of the first pair of hinge members is connected to one of the outer walls.

3. The package of claim 1 wherein both hinge members of the first pair of hinge members are connected to the outer walls.

4. The package of claim 1 wherein the internal wall is configured to completely segregate the first and second cells.

5. The package of claim 4 wherein the first end and second end of each pivot member are not attached to an adjacent wall.

6. The package of claim 1 further comprising first and second locking portions disposed at opposite ends of each cell, wherein each locking portion comprises an engagement edge.

7. The package of claim 6 wherein the engagement edges have a semicircular shape.

8. A package comprising:

four outer walls defining a front wall, a rear wall, and first and second side walls;

an internal wall running between the front and rear walls, wherein the four outer walls and the internal wall define first and second cells;

a first pivot member disposed in the first cell;

a second pivot member disposed in the second cell: and a first pair of hinge members connecting the first pivot member to two of the front, rear, first side, and internal walls defining the first cell and a second pair of hinge members connecting the second pivot member to two of the front, rear, second side, and internal walls defining the second cell;

wherein a first end of the first pivot member is adjacent one of the front, rear, and first side walls, a second end of the first pivot member is adjacent another of the front, rear, or first side walls, a first end of the second pivot member is adjacent one of the front, rear, and second side walls, and a second end of the second pivot member is adjacent the internal wall, such that the first pivot member slants across the first cell and the second pivot member slants across the second cell.

9. The package of claim 8 wherein the first end and second end of each pivot member are not attached to the respective adjacent wall.

10. A blank for producing a package, the blank comprising:

a first glue panel;

a first pivot panel joined to the first glue panel;

a first score line between the first glue panel and the first pivot panel, the first score line comprising a first portion and a second portion, the first portion offset relative to the second portion;

a second glue panel joined to the first pivot panel;

a second score line between the second glue panel and the first pivot panel, the second score line comprising a first portion and a second portion, the first portion offset relative to the second portion;

a plurality of serially-joined wall panels including a first wall panel and a second wall panel, the first wall panel joined to the second glue panel;

a third glue panel joined to the second wall panel of the plurality of serially-joined wall panels;

a second pivot panel joined to the third glue panel;

a third score line between the third glue panel and the second pivot panel, the third score line comprising a first portion and a second portion, the first portion offset relative to the second portion;

a fourth glue panel joined to the second pivot panel; and a fourth score line between the fourth glue panel and the second pivot panel, the fourth score line comprising a first portion and a second portion, the first portion offset relative to the second portion.

11. The blank of claim 10 wherein the first and second pivot panels each comprise a pivot member and a plurality of engagement edges.

12. The blank of claim 11 wherein each engagement edge comprises a curved section.

13. The blank of claim 12 wherein each engagement edge defines in part a cutout section.

14. The blank of claim 10 wherein the first and second pivot panels each comprise a plurality of cutout sections.

* * * * *

UNITED STATES PATENT AND TRADEMARK OFFICE

CERTIFICATE OF CORRECTION

PATENT NO. : 7,357,253 B2
APPLICATION NO. : 11/103349
DATED : April 15, 2008
INVENTOR(S) : Thomas Scott et al.

It is certified that error appears in the above-identified patent and that said Letters Patent is hereby corrected as shown below:

In the Claims

In column 10, in claim 1, line 60, after "of the" delete "front rear second" and substitute --front, rear, second-- in its place.

In column 11, in claim 8, line 33, immediately after "the second cell" delete ":" (colon) and substitute --;-- (semicolon) in its place.

Signed and Sealed this

Second Day of December, 2008

JON W. DUDAS
*Director of the United States Patent and Trademark Office*